US009332612B1

(12) United States Patent
Weaver

(10) Patent No.: US 9,332,612 B1
(45) Date of Patent: May 3, 2016

(54) SYSTEM AND METHOD FOR RAPIDLY GENERATING COLOR MODELS FOR LED-BASED LAMPS

(71) Applicant: Lumenetix, Inc., Scotts Valley, CA (US)

(72) Inventor: Matthew D. Weaver, Aptos, CA (US)

(73) Assignee: LUMENETIX, INC., Scotts Valley, CA (US)

( * ) Notice: Subject to any disclaimer, the term of this patent is extended or adjusted under 35 U.S.C. 154(b) by 0 days.

(21) Appl. No.: 14/631,624

(22) Filed: Feb. 25, 2015

Related U.S. Application Data

(60) Provisional application No. 61/944,509, filed on Feb. 25, 2014.

(51) Int. Cl.
*H05B 37/02* (2006.01)
*H05B 33/08* (2006.01)

(52) U.S. Cl.
CPC ..... *H05B 33/0869* (2013.01); *H05B 33/0863* (2013.01); *H05B 37/02* (2013.01)

(58) Field of Classification Search
CPC ..... H05B 37/02
USPC ..... 315/307, 308, 312
See application file for complete search history.

(56) References Cited

U.S. PATENT DOCUMENTS 7,972,028 B2 7/2011 Durand et al.
2002/0145394 A1* 10/2002 Morgan ..... H04L 29/12254 315/291
2003/0057887 A1* 3/2003 Dowling ..... H05B 37/029 315/291
2006/0158881 A1* 7/2006 Dowling ..... G03G 15/0435 362/231
2011/0187290 A1* 8/2011 Krause ..... H05B 33/0863 315/312

OTHER PUBLICATIONS

Philips, White Paper, Optibin CKTechnology, Technology Overview, Color Consistency for Color and White Light LEDs (online), http://www.colorkinetics.com/support/whitepapers/technology_overview_optibin.pdf [Accessed Apr. 13, 2015], pp. 1-12, 2010.
Schanda, J., et al., "Getting Color Right, Improved Visual Matching with LED Light Sources," (online) http://www.xicato.com/sites/default/files/documents/Getting_Color_Right,_PLDC_2011.pdf [Accessed Apr. 13, 2015], Professional Lighting Design Convention, pp. 1-29, Oct. 19-22, 2011.
Csuiti, Peter et al., "Getting Colour Right: Improved Visual Matching with LED Light Sources", (online) http://www.xicato.com/sites/default/files/documents/Getting%20Color%20Right,%20PLDC%202011.pdf [Accessed Apr. 13, 2015], PLCD 3rd Global Lighting Design Convention, pp. 19-22, 2011.

* cited by examiner

*Primary Examiner* — Tung X Le
(74) *Attorney, Agent, or Firm* — Perkins Coie LLP

(57) ABSTRACT

Some embodiments include a model builder system that generates a color model to facilitate a color tunable lamp to mix the right amount of light from various color channels to reproduce a target color characteristic of a reference lamp. The model builder system can perform pre-computations that characterize the perceived characteristic of individual color channels and the reference lamp. The model builder system can divide the color channels of the color tunable lamp into floating channels and non-floating channels. Holding the operating points of the non-floating channels constant, the model builder system inverse solves for the necessary flux values of the color channels to reproduce the target color characteristic and to optimize color metrics.

24 Claims, 9 Drawing Sheets

SYSTEM AND METHOD FOR RAPIDLY GENERATING COLOR MODELS FOR LED-BASED LAMPS

CROSS-REFERENCE TO RELATED APPLICATION(S)

This application claims the benefit of U.S. Provisional Patent Application No. 61/944,509, entitled "SYSTEM AND METHOD FOR RAPIDLY GENERATING COLOR MODELS FOR LED-BASED LAMPS," which was filed on Feb. 25, 2014, which is incorporated by reference herein in its entirety.

TECHNICAL FIELD

This disclosure relates generally to a color tuning model, and in particular to generating a color tuning model to drive a lamp that mixes different color light from multiple light sources.

BACKGROUND

One approach of producing white light is to mix the light from several colored light sources (e.g., light emitting diodes (LEDs) or tri-phosphor florescent lamps) to create a spectral power distribution (SPD) that appears white. By locating, for example, red, green and blue light sources adjacent to one another, and properly mixing the amount of their outputs, the resulting light can be white in appearance. With the addition of LED light sources to the palette of lighting options for lighting designers, the challenge of getting color right in a project is getting harder. Many designers have experienced this the hard way, with either very disappointing initial installations, or installations failing over time, and having to implement painful fixes. Getting color right is not easy, but it can be done, and involves obtaining and checking the right specifications from the suppliers, and getting a good understanding of the principles of measuring and matching color. It is thus a challenge to match color and to effectively render color without distortion.

The color, or more precisely, the chromaticity, of white light sources falls into the vicinity of a slightly curved line in the CIE chromaticity diagram, called Planckian locus. This curve represents the chromaticity of the light emitted by an ideal black body when it is heated, and is similar to the light generated by an iron rod forged by a blacksmith, or a tungsten filament in a light bulb heated by the current flowing through the filament. The chromaticities of these are in general close to the Planckian locus, and are commonly denoted by the temperature of the black body closest in chromaticity in CIE 1960 chromaticity diagram. This temperature is called correlated color temperature (CCT).

Light-emitting diodes (LEDs) are typically binned by a manufacturer according to output intensity and peak wavelength. However, variations in both output intensity and peak wavelength occur between LEDs in the same bin. For a mixed system that includes multiple channels of multiple white or non-white LEDs that are driven at unique flux levels to produce a combined white light emission, the variations inherent in state of the art binning of the LEDs remains too large. Although the color point of the binning tends to be relatively tight (e.g., 3-step or worse, typically), the luminosity of the LEDs per unit driving current varies substantially more. As a result, the color points for a mixed LED system, which depend on relative channel luminosity as well as color point, routinely deviate three to six MacAdam ellipse steps. Furthermore, the mixed system channel ratios for optimal color metrics, such as color rendering index (CRI), color quality scale (CQS), and R9, may vary even more with variations in peak wavelength and phosphor emission profile. The same CRI may require a different blend of channel weights (e.g., different flux/lumens values from different colored light sources) if the spectra from each light source (e.g., LED) are slightly different. Consequently, the output of an LED-based lamp with LEDs from the same bin can vary dramatically. There is thus a need to develop a way to model each LED-based lamp accurately such that the output color and intensity of the lamp is to be predictably adjusted.

DISCLOSURE OVERVIEW

One way to accurately model how to predictably adjust the output color and intensity of a lamp is by building a color model for the lamp. An inverse solver algorithm is described below that selects one or more target color points for the color model to match. An inverse solver system can decompose component spectra from each color channel that produces a total spectrum of the lamp. The inverse solver system can then multiply the component spectra from each color channel against specific color cards to obtain reflectivities and tristimulus values for the component spectra. Using the associate properties of reflectivities and tristimulus values, the component values can later be summed together when the appropriate color points of the individual channels have been determined. The inverse solver system can solve for weights respectively for the different color channels that would produce the target color points as described below.

Multi-color-channel lamps fundamentally can achieve the highest energy efficiencies (e.g., lumens per watt), as well was highest color fidelity & control (e.g., over single-source or single phosphor blend). The market trend anticipates that as artificial lighting matures, multi-color-channel lamps would play an increasing and substantial role in lighting. In several embodiment, positive lamp attributes arise from a system of 5 or more channels. Channel variation in real-world lamp arrays are sufficiently large as to preclude "fixed model" ratios of lamp channels—necessitating model solution on a per-lamp basis. Color metrics and solution space involved with higher channel counts present a difficult problem using an empirical computational method with conventional computers. A fast inverse solver algorithm is a method to characterize each multi-color-channel lamp to predictably produce optimized color models for reproducing target color points, while retaining high flexibility in color/operating criteria. The fast inverse solver can enable high-volume production timeframes (e.g., few seconds or less) as compared to the empirical computation method.

Some embodiments of this disclosure have other aspects, elements, features, and steps in addition to or in place of what is described above. These potential additions and replacements are described throughout the rest of the specification

Figure 1:
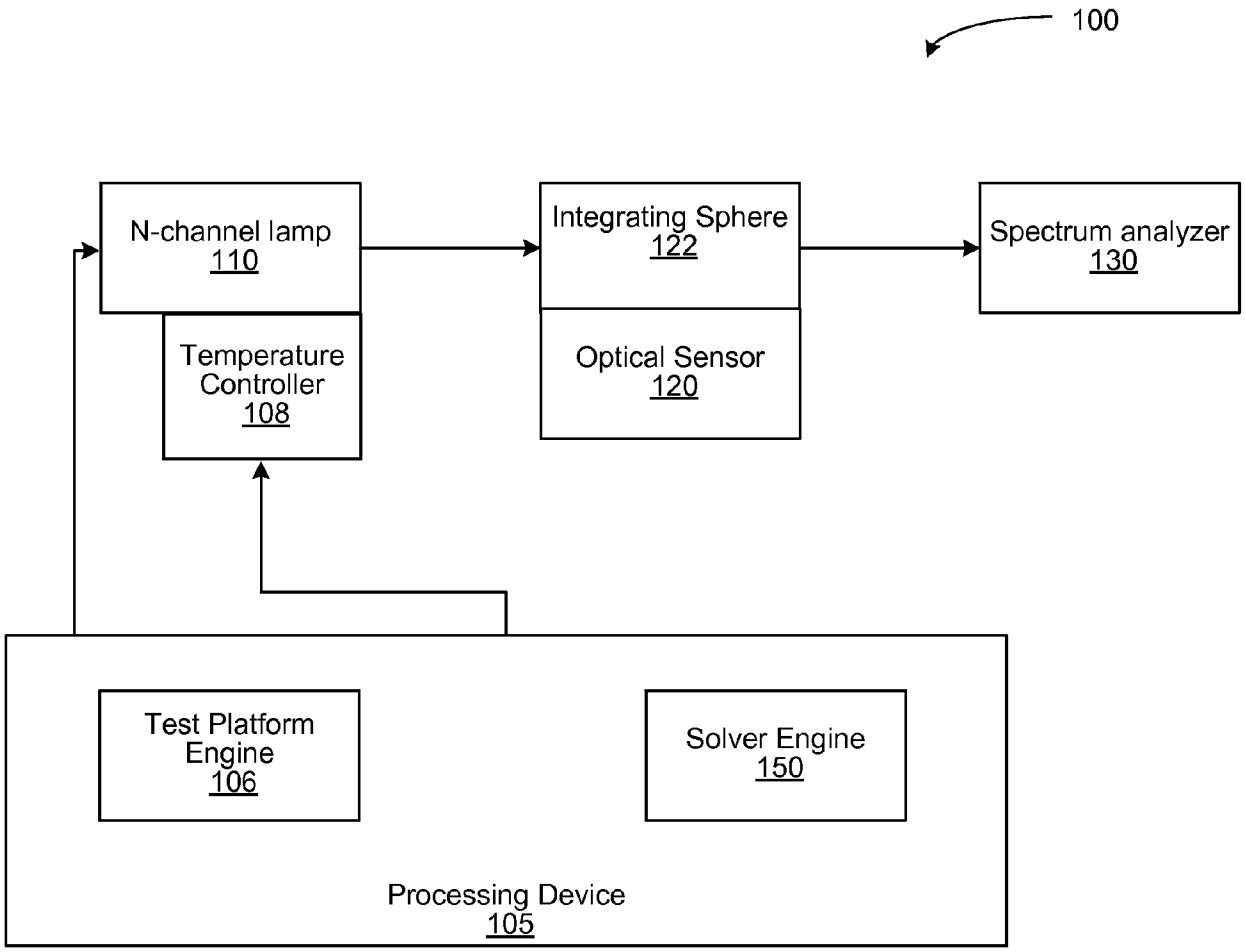
FIG. 1 shows an example of a model builder system, in accordance with various embodiments.

The figures depict various embodiments of this disclosure for purposes of illustration only. One skilled in the art will readily recognize from the following discussion that alternative embodiments of the structures and methods illustrated herein may be employed without departing from the principles of embodiments described herein.

DETAILED DESCRIPTION

Color Models for LED-Based Lamps

A light source can be characterized by its color temperature and by its color rendering index (CRI). The color temperature of a light source is the temperature at which the color of light emitted from a heated black-body radiator is matched by the color of the light source. For a light source which does not substantially emulate a black body radiator, such as a fluorescent bulb or a light-emitting diode (LED), the correlated color temperature (CCT) of the light source is the temperature at which the color of light emitted from a heated black-body radiator is approximated by the color of the light source. The CRI of a light source is a measure of the ability of a light source to reproduce the colors of various objects faithfully in comparison with an ideal or natural light source. The CCT and CRI of LED light sources is typically difficult to tune and adjust. Further difficulty arises when trying to maintain an acceptable CRI while varying the CCT of a multi-channel LED light source.

When moving away from thermal emission for light generation, and using plasma discharge, fluorescence, and solid state emission, a system can characterize the light emission not only by CCT, but also by the distance to the Planckian locus. This distance is measured in the CIE 1960 chromaticity diagram, and is indicated by the symbol uv, or DUV. It is usual that if the chromaticity is above the Planckian locus the DUV is denoted by a positive number, if it is below, it is indicated with a negative number. If the DUV is too positive, the light source appears too greenish, or yellowish, if the DUV is too negative, the light source can appear to be purple, or pinkish, at same CCT.

To create uniform lighting, it is required that all the lights have the 'same color', or more precisely, are visually matched. Due to manufacturing tolerances, temperature variations, and varying drive conditions, the chromaticity of light sources will vary. The sensitivity of the human eye to color differences depends on many factors, but in simplified form can be characterized by ellipses in chromaticity diagrams, where the ellipses represent standard deviations of color matching (SDCM) or just noticeable differences of chromaticity (JNDC). First work in this field was performed by MacAdam in 1942, and sometimes these ellipses are historically referred to as MacAdam ellipses, but much work has been done in this field since then, resulting in adoption of the CIE1976 u'v' chromaticity diagram, and the definition of color difference formulas denoted by ΔE, deltaE, or DE.

The overall CCT of the light generated by a multi-channel LED-based lamp is sensitive to the relative amount of light produced by the different color LEDs and the spectral content of the light. Multi-channel LED lamps are multiple white or non-white LED sources that are driven at unique flux levels to produce a combined emission that appears as white light to an observer. Multi-channel LED lamps are distinguishable from single-package phosphor-converted white light LED sources. While the manufacturer of LEDs may provide a data sheet for each bin of LEDs, the LEDs in a bin still vary in their peak wavelength and in the produced light intensity (lumens per watt of input power or lumens per driving current). If even a single LED has a peak wavelength or intensity that varies from the ideal LED described in a data sheet, the resulting lamp CCT difference can be noticeable. It is very likely that more than one LED will vary from the data sheet specifications. Further, the peak wavelength and intensity of an LED varies as the driving current for the LED changes. Thus, it would be beneficial to generate a custom color model for each set of LEDs in a lamp. In particular, the color model can incorporate not only the brightness of the LED channel(s) with varying driving current but also the color point, i.e., the full tristimulus state of the color channel with varying driving current as well as temperature. The color model for the lamp also provides information on how hard to drive each LED string or color channel in the lamp to result in the generation of light from the lamp having a certain output power over a range of known CCTs.

For a three channel LED-based lamp that only has three different color channels, the color model is deterministic because for a given color point or CCT, there is only a single solution. Increasing the number of different color channels in a lamp to four results in a trajectory of solutions for each color point, which is also straight-forward to model. However, when the LED-based lamp has five color channels, there are an infinite number of solutions for every single color point, and each solution has different color qualities (e.g., CRI).

Empirical Method of Computing Color Quality

Under an empirical method of color matching, an empirical solver system can obtain color quality metrics, such as CRI, CQS (color quality scale), mCRI (memory color rendering index), gamut area, and R9, for a particular lamp following the following steps. The gamut area represents a complete subset of colors which can be accurately represented in a given circumstance, such as within a given color space and/or by a certain output device (e.g., the lamp).

The empirical solver system obtains a test spectrum from the lamp which defines the CCT. In other words, a sensor system can measure the spectrum of the lamp, and a model builder can calculate the CCT of the measured spectrum from the measured spectrum. With the CCT defined, the model builder can generate a reference lamp spectrum for that unique CCT. For example, the reference lamp spectrum can be in reference to a Planckian blackbody emission spectrum or a computed daylight illuminant spectrum. The model builder can multiply the measured lamp spectrum (e.g., the "test lamp spectrum") and the reference lamp spectrum against an array of standard color cards that span a broad gamut area of color space, typically 8 to 15 color cards. Color cards are reference color samples in one of the standardized color space (e.g., CIE 1964 color space). Then, the model builder can quantitatively compare the difference in luminosity and color point of the light reflecting off the color cards for each spectrum to obtain one or more color qualities for the test lamp.

The empirical method for computing color quality for a given lamp is computationally intensive. The first step involves the sensor system measuring the test spectra for the lamp. The spectral intensity of each of the N individual color channels of the lamp is measured over a range of power levels, and then model builder sums the spectra from each of the color channels to compute the test spectra as an aggregate. In some cases, because the obtainable color space with five or more channels can have multiple maxima and minima for various color metric measurements, such as CRI and R9 (e.g., a color rendering value used to quantify a lamp's ability to produce vivid red), a resolution of about 400 steps between the minimum driving current and the maximum driving current for each channel are used to obtain sufficient data to determine combinations of driven LEDs to generate particular CCT output values. In those cases, for a five color channel lamp, the number of possible spectral combinations is $400^5$ or 10.24 trillion, and each of these spectral combinations has to be analyzed to build an accurate color model. Because each individual spectrum includes spectral data taken at a one-nanometer spacing across the visible spectrum, spanning up to 830 nm, the computation involved to compute a possible test spectra (e.g., different test spectrum produced by the lamp based on different steps in different color channels) is highly intensive.

The next step in the empirical method of color model generation is to perform a dot product of each of the possible spectral combinations against mathematical functions representing the response of the human eye to obtain the X, Y, Z tristimulus values, where Y is a measure of luminance, Z is a measure of blue stimulation of the human eye, and X is a linear combination of human eye cone cell response curves.

After the tristimulus values are obtained, an equivalent CCT for each of the 10.24 trillion spectra is determined. One method for determining the equivalent CCT is to perform a McCamy cubic approximation, as provided by: $CCT(x,y)=-449n^3+3525n^2-6823.3n+5520.33$, where n is the inverse slope line. However, chromatic adaptation is also needed to resolve persistent color point differences between the test spectrum and the reference spectrum. With the empirical technique, the CCT is unknown until the test spectra for each of the individual color channels are combined, and the CCT must be calculated for each possible combination of power level of each color channel.

Next, a reference spectrum is generated for each unique CCT obtained in the previous step. For CCT values less than 5000K, a blackbody can be used for the reference source, and the Planckian radiation distribution is calculated directly for the given CCT. For all other CCT values, a standard daylight illuminant is used that is based on a daylight spectrum.

For each color point to be calculated, both the test spectrum and the reference spectrum are multiplied against each of the standard color card reflectivities, where the color card reflectivities are a set of reflection coefficients over the visible spectrum, and the reflection coefficient is one for a perfect reflection and less than one otherwise. After multiplying by the reflectivity coefficient of the test color card for each wavelength, the result is a reflected spectrum that is multiplied by eye response curves (typically, for bright illumination around 50-1000 lux levels) for a 2° standard observer for XYZ tristimulus values associated with the reflected light for each card. (While there are other standard observer profiles, they are very similar in principle with only slight variations.) Three full spectrum products are performed for each color card. Thus, the product is obtained wavelength by wavelength and then the products for each wavelength is summed for both the test spectrum and the reference spectrum to obtain a point in a three-dimensional (3D) color space comprising luminosity (brightness) and a two-dimensional color coordinate for the test spectrum and another point for the reference spectrum.

The uv space coordinates are calculated for XYZ tristimulus values for all color card reflections, and the color points are then verified as to whether they are close enough to be valid, i.e., Δuv space less than 0.0054. Then the UVW* coordinates are calculated from uv and Y.

The 3D color point obtained for the test spectrum and the 3D color point obtained for the reference spectrum do not necessarily coincide. The larger the difference between these two color points, the more color distortion is perceived by the human eye. So although the test lamp and the reference lamp may have the same color temperature and color coordinate, they can have different spectra.

The CCT color points of the test lamp may be above or below the blackbody Planckian locus or the daylight spectrum locus in color space. To minimize the influence of the color delta between the actual color point and the desired locus of the reference spectrum, a chromatic adaptation calculation needs to be performed on all color points prior to evaluating the color difference and subsequent R values.

Then the Euclidean distance (ΔE) between the chromatically adapted color points in UVW* space between the test card and the reference lamp reflections, is calculated for each color card reflectivity. Both test spectral source and the reference lamp source are normalized, for example, to 100 lumens.

Next, the R value (also referred to as the special CRI) for each of the color cards is calculated based on the respective ΔE values: $R=100-4.6\Delta E$. In particular, R9 is a useful indicator for how well the light shows deep saturated shades of red. And finally, CRI is calculated as the average of the R values for color cards 1 through 8.

Thus, with the empirical method of calculating color quality for a multi-channel lamp, there are a large number of data points to be manipulated to obtain a color model for the lamp. Described below is a greatly improved algorithm for obtaining a color model with many fewer computational steps.

Generating Color Models Rapidly with an Inverse Solver Algorithm

FIG. 1 shows an example of a model builder system 100, in accordance with various embodiments. The model builder system 100 can include an integrating sphere 122 coupled together with an optical sensor 120 (e.g., the same sensor system as with the empirical method). The optical sensor 120 can sense the output from an N-channel lamp 110 (e.g., LED-based lamp) that is controlled by a processing device 105 (e.g. the computing device 700 of FIG. 7). The processing device 105 can implement a test platform engine 106. The test platform engine 106 can turn on each LED or LED string (e.g., a string of LEDs of the same color) individually and control the driving current from a minimum amount of current needed for stable operation to the maximum amount of current to be used for that color channel. In some embodiments, the test platform engine 106 can control the operating temperature of the LED array utilizing a temperature controller 108. For example, the temperature controller 108 can be a closed-loop, Peltier-device for heating and/or cooling the base of an LED array (e.g., although not the individual LEDs in the array) to a specified operating temperature.

Under the empirical method for obtaining color quality data, the number of steps between the minimum and maximum driven current should be about 400. However, with the inverse solver algorithm, far fewer than 400 steps can be used per channel. It is only necessary to take a sufficient number of spectral measurements to capture the curvature of the tristimulus values (e.g., "XYZ") profiles with command inputs to the LED driver in the N-channel lamp 110. In some instances, anywhere from three to ten sample spectral operating states spanning the minimum to maximum are evaluated and the test platform engine 106 can fit spline curves to the sample spectral operating states. Key operating points to sample include where any discontinuity in curvature occurs, as would typically arise from the driver electronics, for example, a change from continuous current to variable pulse width at fixed minimum current at lower output levels, etc. The fitted spline curves are then divided into a higher number of test points, typically 400 or higher. The driving current steps can be linear, non-linear, or even arbitrary, for example, more closely spaced steps can be taken over particular current ranges to capture possible or points of inflection inherent in the flux/command curve, which typically occurs at a point that may transition between pulse width modulation mode and continuous output/variable current mode driving the LEDs. For each step, the output light from the N-channel lamp 110 is measured by an optical sensor 120 with an integrating sphere 122. A spectrum analyzer 130 can receive the output from the optical sensor 120 and determine a magnitude of the intensity in radiometric units (watts/nm). The spectrum analyzer 130 or the processing device 105 can also convert the output of the optical sensor 120 to lumens and color point as a function of frequency, e.g., an intensity spectrum. In turn, the spectrum analyzer 130 can provide spectral data for each individual color channel of the N-channel lamp 110 over a range of driving currents.

Figure 6A:
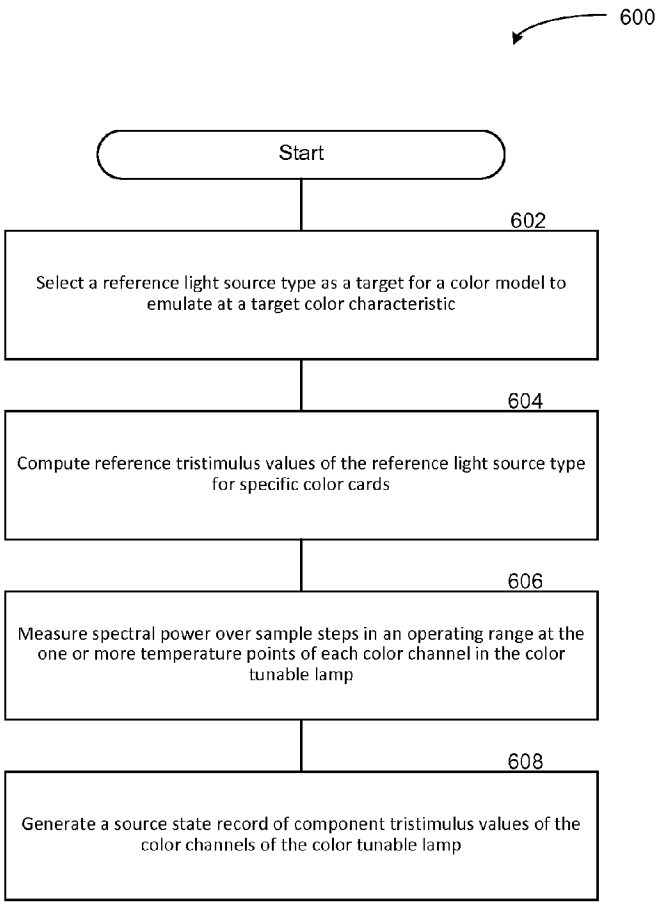
FIG. 6A is a flow diagram illustrating a method of building a pre-computation record for the inverse solver algorithm, in accordance with various embodiments.
Figure 6B:
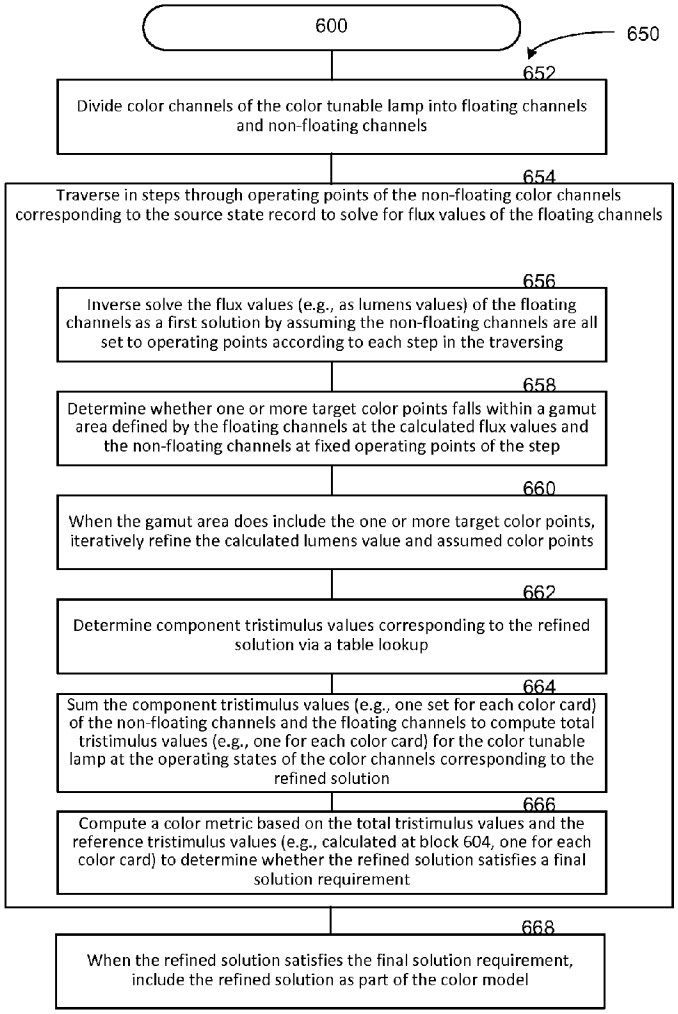
FIG. 6B is a flow diagram illustrating a method of solving for operating commands to a color tunable lamp such that the color tunable lamp produces light to match a target color point produced by a reference lamp type utilizing the pre-computation record of FIG. 6A, in accordance with various embodiments.
Figure 7:
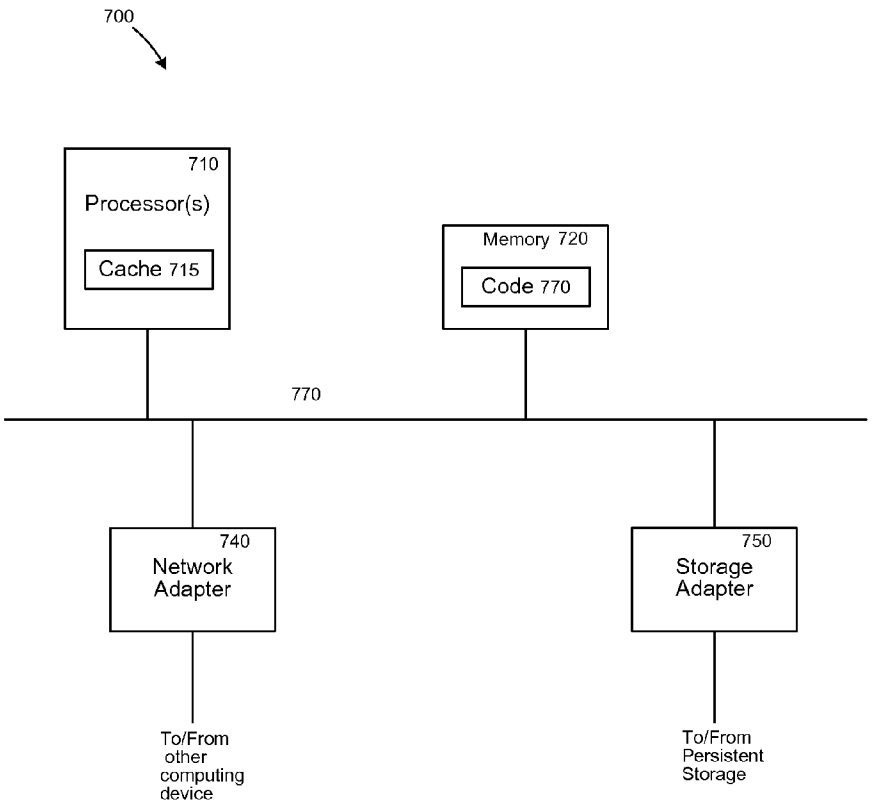
FIG. 7 is a block diagram of an example of a computing device, which may represent one or more computing device or server described herein, in accordance with various embodiments.

The model builder system 100 can further include a solver engine 150 (e.g., implemented by a computing device, such as the computing device 700 of FIG. 7). The solver engine 150 can implement the processes (e.g., the inverse solver algorithm) described in FIGS. 3A-3B and/or FIGS. 6A-6B to compute a color model based on the spectral data.

Functional components (e.g., engines, devices, modules, and databases) associated with the model builder system 100 can be implemented as circuitry, firmware, software, or other functional instructions. For example, the functional components can be implemented in the form of special-purpose circuitry, in the form of one or more appropriately programmed processors, a single board chip, a field programmable gate array, a network-capable computing device, a virtual machine, a cloud computing environment, or any combination thereof. For example, the functional components described can be implemented as instructions on a tangible storage memory capable of being executed by a processor or other integrated circuit chip. The tangible storage memory may be volatile or non-volatile memory. In some embodiments, the volatile memory may be considered "non-transitory" in the sense that it is not a transitory signal. Memory space and storages described in the figures can be implemented with the tangible storage memory as well, including volatile or non-volatile memory.

Each of the functional components may operate individually and independently of other functional components. Some or all of the functional components may be executed on the same host device or on separate devices. The separate devices can be coupled through one or more communication channels (e.g., wireless or wired channel) to coordinate their operations. Some or all of the functional components may be combined as one component. A single functional component may be divided into sub-components, each sub-component performing separate method step or method steps of the single component.

In some embodiments, at least some of the functional components share access to a memory space. For example, one functional component may access data accessed by or transformed by another functional component. The functional components may be considered "coupled" to one another if they share a physical connection or a virtual connection, directly or indirectly, allowing data accessed or modified by one functional component to be accessed in another functional component. In some embodiments, at least some of the functional components can be upgraded or modified remotely (e.g., by reconfiguring executable instructions that implements a portion of the functional components). The systems, engines, or devices described may include additional, fewer, or different functional components for various applications.

Figure 2:
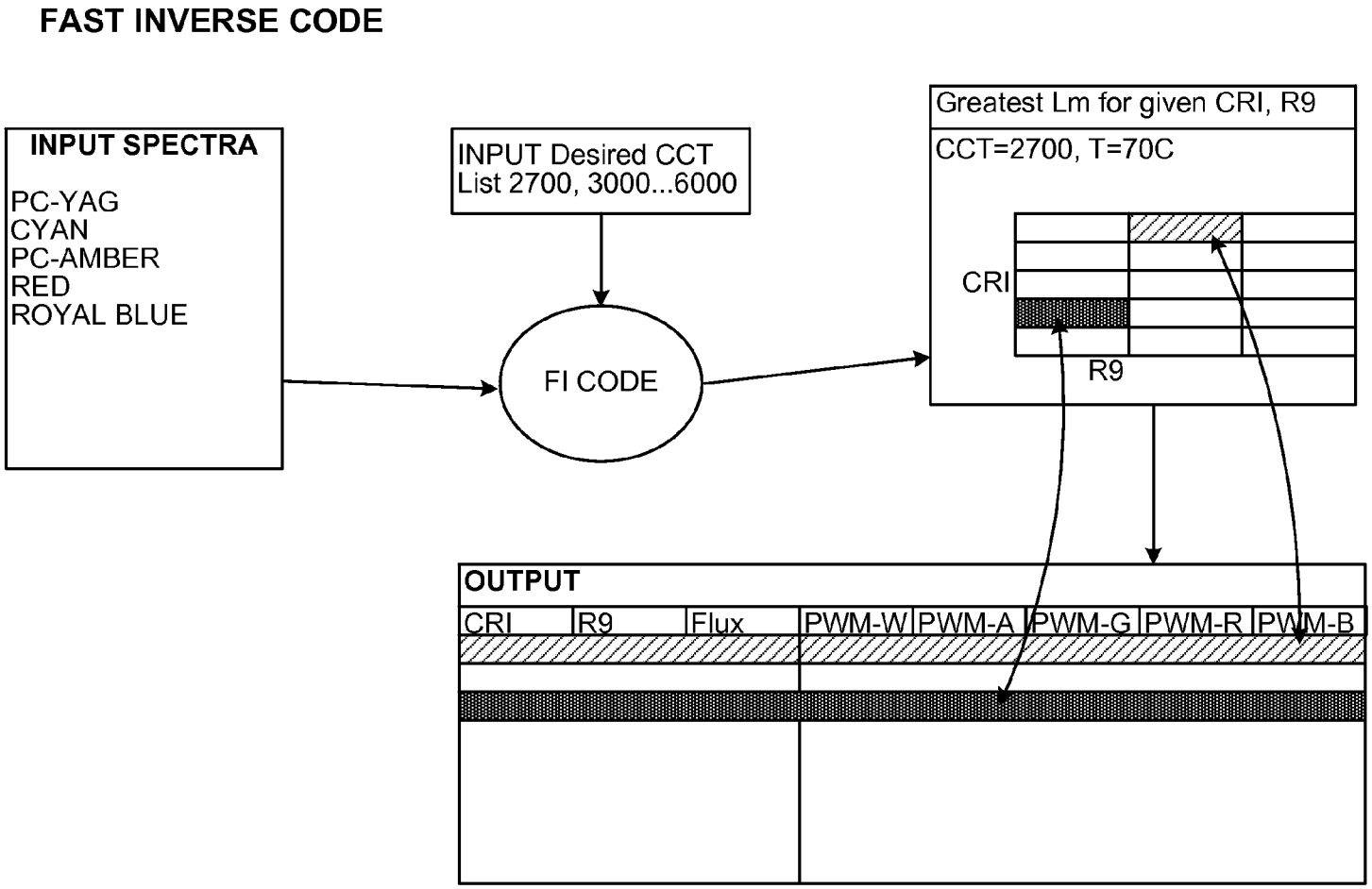
FIG. 2 is a data flow diagram illustrating input and output data by an inverse solver algorithm, in accordance with various embodiments.

FIG. 2 is a data flow diagram illustrating input and output data by the inverse solver algorithm, in accordance with various embodiments. The inverse solver algorithm takes as input the measured input spectra for each of the color channels in the lamp over a range of driving currents. The inverse solver algorithm also takes as an input a set of target color points for the color model to match. For example, the target color points can be specific CCT values. As a particular example, the target color points can correspond to discrete CCT values between 2700K and 6500K.

As yet another input to the inverse solver algorithm, color metric constraints can be specified. For example, the color metric constraints can include a minimum CRI; a minimum R9; a maximum thermal wattage limit; a maximum electrical wattage limit to flatten the lumen output curve: a maximum specifications on dimming curve, e.g., warm dimming; a gamut area; a gamut area combination, e.g., geometric mean of gamut area and a specified CRI; an efficacy, e.g., at a given lumen output or LED percentage utilization; lumens, e.g., lumen output flattening, normalization, or curve fitting of profiles; optimization at multiple temperature points by taking spectra at multiple temperature ranges; other color quality metrics, e.g., CQS, nCRI, memory CRI; and/or constraints on other color qualities; or any combination thereof. The color metric constraints can be a maximum threshold or a minimum threshold. Other color metrics that can be used to construct the color metric constraints include Qa (i.e., a NIST color quality scale CQS), special CQS (i.e., Qi, where "i" is from 1-15 corresponding to standard color cards), Qf (i.e., NIST color fidelity), Qp (i.e., NIST color preference scale), Qg (NIST gamut area scale—"vividness"), nCRI, mCRI (i.e., memory colors), gamut area index (GAI), or any combination thereof.

The inverse solver algorithm can then generate color model as a table of XYZ/lumen flux values or electrical command values (e.g., an 8-bit number between 0 and 256 for non-high-dynamic range lamps, or a 16-bit control number for high dynamic range lamps, such as a lamp capable of operating as a night light with full color control). The table can also include current values for driving each of the color channels along with the resulting modeled CRI, R9, and flux at each of the target color points (e.g., specified CCT values). For example, the current values enable a driving circuit of the N-channel lamp 110 of FIG. 1 to produce the target color points while best meeting the specified color metric constraints. In a lamp with four or more channels, there can be tens of millions of valid solutions that meet the minimum specifications, but the solution that meets a simultaneous set of specifications is the only solution that is used and identified in the table serving as the color model.

Figure 3A:
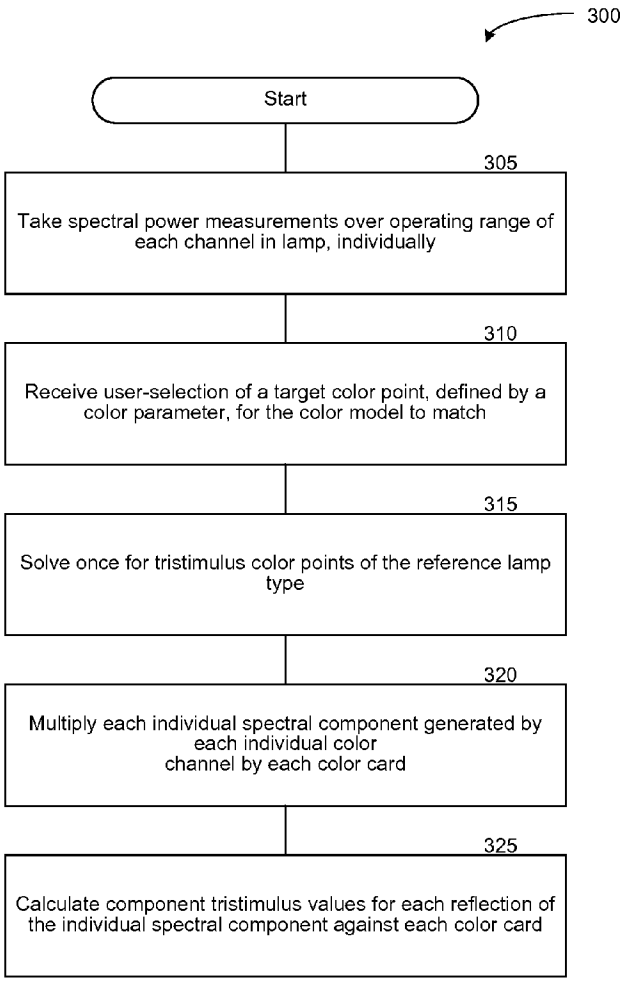
FIG. 3A is a flow diagram illustrating a first part of a method of executing the inverse solver algorithm to generate a color model for a color tunable lamp, in accordance with various embodiments.

FIG. 3A is a flow diagram illustrating a first part of a method 300 of executing the inverse solver algorithm to generate a color model for a color tunable lamp (e.g., the N-channel lamp 110 of FIG. 1), in accordance with various embodiments. The color tunable lamp can be referred to as the "test lamp." At block 305, the model builder system 100 takes spectral power measurements for each color channel in the color tunable lamp, individually, over an operating range of the each color channel.

Then at block 310, the model builder system 100 can receive user-selection of target color points for the color model to match. The target color points can be selected by a user when the color model is being generated or preconfigured in the model builder system 100 prior to commencing of the method 300. For example, the target color points can be specified as a CCT value, an off-locus color point (e.g., a positive or negative DUV shift from a CCT value), or an arbitrary color value (e.g., specified under CIE 1931 RGB color space standard or under CIE 1931 xy chromaticity standard). For example, the CCT values are initially selected so that the CCT for each possible combination of color channel outputs no longer need to be determined as with the empirical method.

In several embodiments, the selection of the target color points can reference a reference lamp type having a known reference spectra. For example, a CCT value can reference a black body emitter or a day light spectrum. For example, other reference lamp types include an "off locus" spectra, hue saturation transitional spectra (e.g., moving from a white point to a pure color), an "enhanced" spectra, and a channel decomposition spectra. The channel decomposition spectra can treat a phosphor-pump source as a composite of a blue source peak and phosphor emission, allowing later independent mapping of phosphor and blue source decay in aging calibration calculations.

The enhanced spectra can be a reference spectra designed to maximize or minimize the response of one or more standard reflectivity color cards while maintaining the same white point (e.g., the same CCT value). The enhanced spectra can be a reference spectra designed to enhance a certain color, such as violet color enhancement or deep red enhancement using standard color cards or a custom card). The enhanced spectra can be a reference spectra designed to minimize potential damage to a certain material (e.g., using a "damage potential" custom color card/spectral function). The enhanced spectra can be a reference spectra designed to maximize or minimize melatonin response (e.g., using a "melatonin response" custom color card). The enhanced spectra can be a reference spectra designed to minimize hazardous light, such as hazardous blue energy response or wildlife damaging light, using a "hazardous response" custom color card).

Next, at block 315, the solver engine 150 can solve for one or more color points of the reference lamp type based on one or more color parameters (e.g., the specified CCT values). For example, the solver engine can look up reference spectrum of the reference lamp type from a table for either the blackbody reference spectrum or the standard daylight illuminant spectrum. The solver engine 150 can identify or determine the reference spectrum at a specified CCT. In the case of the blackbody reference lamp, the reference spectrum is equal to a Planckian radiation of a heated body at the same temperature that the specified CCT value. In the case of the daylight illuminant reference lamp, the reference spectrum is a spectral function based on historical observations of actual solar emissions that break down into sub-components, which vary individually with atmospheric conditions. The spectral function of the daylight illuminant can largely embody the behavior the solar spectrum as it varies in CCT.

The CRI calculation utilizes the daylight illuminant for CCT values greater than 5000K, and a blackbody for lower CCT values. There is a slight discontinuity in the locus of these two curves with varying CCT values. In some embodiments, to address this issue, the inverse solver algorithm can perform a progressive blending of the two curves (e.g., the blackbody curve and the daylight illuminant curve in the color space) around 5000K CCT to eliminate the discontinuity when transitioning through 5000K with a color tunable lamp.

For off-locus reference spectra that have color (e.g., rather than a classic white spectrum), instead of optimizing for CRI or R9, the inverse solver algorithm can optimize for lumens per watt or another color metric, such as an nCRI-type color metric. Reference spectra can consist of a point along non-overlapping progressive spectral blend trajectories between a pure saturated color point (e.g., narrow-band red, orange, yellow, green, cyan, blue, violet, etc.) and a CCT point along the classic white spectrum (e.g., daylight illuminant or blackbody Planckian source).

Once the solver engine 150 identifies the reference spectrum from the table, the solver engine 150 can calculate target tristimulus (XYZ) values corresponding to the selected target color points by multiplying the reference spectrum against each of a set of color card (e.g., TCS01 . . . TCS15). The color cards represent reflectivity spectrum of test surfaces. These can be standard or custom reflectivity color cards. From the target tristimulus values, the solver engine 150 can also calculate coordinates of the target color points in the u,v and UVW* color space for the reflected light off of each of the color cards. With the UVW* color space points solved and available, the solver engine 150 can further compute and solve the color delta metamerisms with minimal additional computation for the reference lamp.

Color cards are useful in computing color metrics. Color cards are pre-defined by each color metric. Several color metrics may depend on characteristics of a spectral power multiplied against a color card. For example, for the color quality metric CRI, the standard color cards used can be "TCS1" to "TCS14," where "TCS" stands for "Test Color Sample." The reference tristimulus values can refer to the color points of the reference light source type when reflected off a color card (e.g., dot product with a color card's reflectivity profile with the reference spectrum, then solving for the XYZ of that reflected light). Other color metrics, such as CQS and nCRI can used other color cards defined respectively by their standards. For example, nCRI uses yet another that is "synthetic" in design, where the reflectivities of the color cards are represented by phased wavelets centered at different visible colors from violet to deep red. The units of the color cards can be reflectivity (e.g., within a range of 0 to 1.0) as a function of wavelength or frequency.

In comparison to the empirical method, the inverse solver algorithm does not need to solve for a corresponding CCT in response to determining color spectrum of the color tunable lamp (e.g., the test lamp). In turn, the inverse solver algorithm does not need to generate a reference spectrum in response to solving for the corresponding CCT. Accordingly, no significant computation time is spent on the reference spectrum with the inverse solver algorithm.

Next, at block 320, the solver engine 150 multiplies the individual spectral component properties of each individual color channel obtained at block 305 against a set of color cards (e.g., the set of color cards used at block 315) to obtain a set of reflectivities for each color channel at each operating power step. The color tunable lamp has multiple color channels contributing to the overall lamp spectrum. Under the inverse solver algorithm, rather than multiplying each spectrum produced by the color tunable lamp as a whole to the set of color cards as in the empirical method, the solver engine 150 multiplies individual spectral components of the color channels, individually, against the set of color cards to produce channel-specific reflected spectral components.

When these reflected spectral components are summed together, the result is the same as when the combined spectrum from the color tunable lamp were multiplied against the color cards. This is achieved due to the associative property of reflectivity. For example, the reflected spectral component can be represented by a N×1 array. A reflected spectral component is derived by multiplying a N×1 array representing the individual spectral component obtained at block 305 against a N×1 array representing a reflectivity color card. The solver engine 150 can then used the reflected spectral components to calculate channel-specific tristimulus component values (e.g., expressed in the XYZ tristimulus color space). The tristimulus component values are each scalar values (e.g., X, Y, and Z respectively). The solver engine 150 can compute the tristimulus component values by multiplying the N×1 array representing the reflected spectral component by a 1×N transformation matrix. One by three (1×3) arrays can represent the tristimulus component values. Adding the tristimulus component values together can yield the same result as summing the combined spectrum produced by the color tunable lamp and then solving for the total tristimulus values.

Under the empirical method, the tristimulus value calculation would need to be done for each and every full test spectrum. Under the inverse solver algorithm, given all the test spectra, if they have a solution (e.g., a set of operating points corresponding to the color channels) that matches the target color point at all, the solution would map to exactly the same color point. Accordingly, the solver engine 150 would perform the computation of the component tristimulus values only once. Ultimately, within an iterative loop of the inverse solver algorithm, the solver engine 150 can reconstruct the total tristimulus value (e.g., XYZ) for each color card based on the pre-compute tables of the known states of the lamp colors, where the pre-compute tables (e.g., source state record) include component tristimulus values corresponding respectively to the color channels.

Reflectivities obtained at block 320 map to corresponding tristimulus values to be calculated at block 325 for each color channel at each power level. That is, at block 325, the component tristimulus values corresponding to each of the reflectivities of the individual spectra obtained at block 320 is calculated. Because color calculations are ultimately concerned with how the human eye perceives the color, there is no need to work with all of the possible combinations of spectra or radiant energy per wavelength spanning the spectrum as long as the combinations result in the same tristimulus values. However, the full spectrum is used when multiplying against the reflectivity of a test color card, although this product can be performed in advance and all subsequent calculations work with XYZ or the source fractions that sum together to form the XYZ values. that can be generated by the lamp. Only the tristimulus values of the spectra produced by each individual color channel need to be calculated. It is important to calculate the tristimulus values for the entire range of minimum current to maximum current because the actual color point of an LED changes significantly over the operating current range. The "Y" or flux/lumens value changes most significantly with LED current, but color point or x,y values, where x=X/(X+Y+Z) and y=(Y/(X+Y+Z), also change with current).

As a result of the first part of the method 300, a precomputed table of reference tristimulus values (e.g., based on the reference spectrum and/or the reference spectrum reflected off of one or more color cards) would be available for subsequent access during the second part of the method 300. Similarly, as a result of the first part of the method 300, a precomputed table of component tristimulus values (e.g., based on the component spectrum of each color channel and/or the component spectrum reflected off of the color cards) will be available for subsequent access during the second part of the method 300.

Figure 3B:
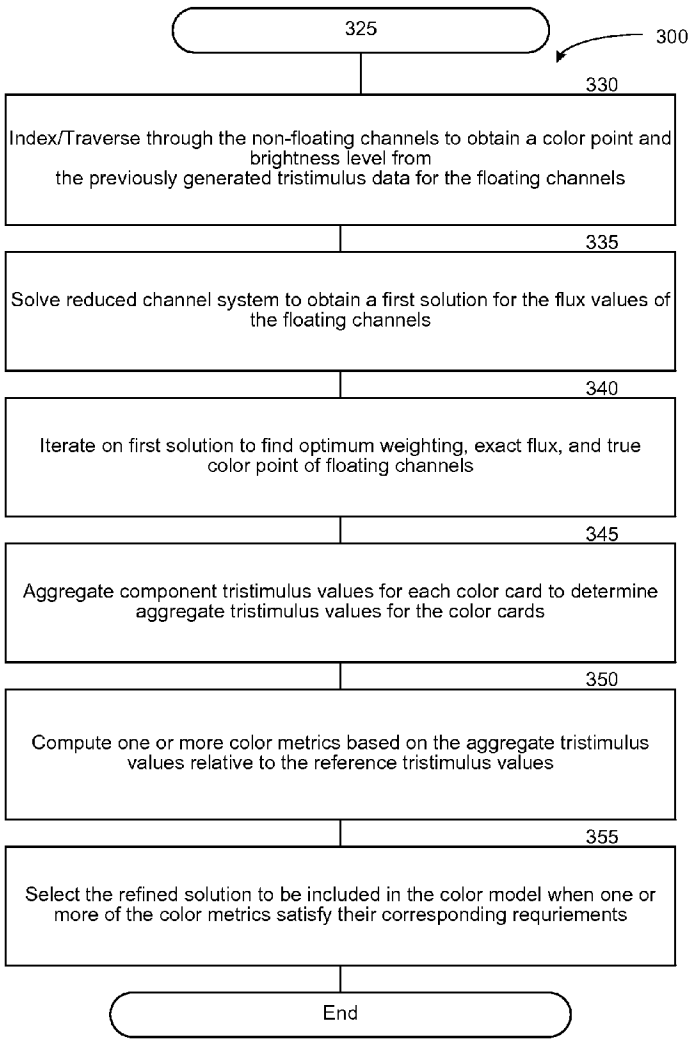
FIG. 3B is a flow diagram illustrating a second part of the method of executing the inverse solver algorithm, in accordance with various embodiments.

FIG. 3B is a flow diagram illustrating a second part of the method 300 of executing the inverse solver algorithm, in accordance with various embodiments. Blocks 305 through 325 can be pre-computed to obtain values to be used in the second portion of inverse solver portion of the algorithm described in blocks 330-345 below. In the structure of the pre-computed records that the algorithm uses for the source states, the spectrum, operating power, and temperature associated with each individual LED channel is logged. From that information, the tristimulus (XYZ) values are computed. Additionally, the radiometric power is directly computed from the spectrum. The source state record then consists of XYZWRTP, where W is electrical wattage, R is radiometric emission wattage, T is temperature, and P is a control command value. The pre-computed records can be stored in an 8-wide floating point vector that is manipulated directly in an 8-wide single instruction, multiple data (SIMD) advanced vector extensions (AVX) instruction in the algorithm when the source components are summed together. Other values that can be stored in an entry of the source state record can include a total input power (e.g., limiting load on electrical drivers), total thermal power (e.g., limiting thermal heat, such as electrical input minus light radiation), efficacy (lumens/watt), total lumens (for matching lamp output), high limit curve, low limit curve, or any combination thereof. The source state record can be loaded as a table to a L1 cache of CPU used to perform the second part of the method 300.

The inverse solver algorithm can be used for any number of channels greater than or equal to three. At block 330, the solver uses a technique where only information from non-floating channels (e.g., N-2 channels, N being the total number of channels) are used to determine a color point. Any three of the five channels may be used, although there are subtle differences in the size and percentage of validity of the solution space, and the precision of the solution depending on the channels chosen. These differences can be exploited to marginally improve the speed the solution time and accuracy Thus, if there are five different color channels in the lamp, the non-floating channels are indexed by the algorithm to produce a combined tristimulus result. The non-floating channels correspond to a particular 2D color point having a known brightness.

The other two channels are referred to as floating channels because, although the color of the floating channels are known, the brightness of the floating channels has yet to be determined to make the combination of the three color points yield a specified color point. An initial starting point is provided for the color of the floating channels, but the color can shift for different flux levels. In some instances, the actual output of the channel at mid-power (half of maximum of driving current) flux and mid temperature. So the floating channels (e.g., 2 in the case of a 5 color channel lamp) along with the color point that represents the non-floating channels make up three points in color space that together define a gamut area (e.g., the non-floating channels having a known color point and the floating channels having known color points but not known operating current/flux), and the system has been reduced to a reduced channel system (e.g., the non-floating channel being having a known color point and known aggregate lumens and the floating channels having known color but variable lumens) that is reduced to two unknowns, flux levels of the two floating channels. At block 335, the reduced channel system is solved to obtain the flux or brightness levels for the two floating channels. In solving for the flux levels of the floating channels, a guess for the weights for each of the floating channels is made. The color point of the non-floating channel (i.e., the combined non-floating channels at specific indexed values) is an absolute value. It has a specific XYZ value, as well as electrical wattage, radiant energy, Y=lumens, color point x,y, where x=X/(X+Y+Z), and y=Y/(X+Y+Z)). The lumens of the two floating channels is unknown. All the individual LED sources are stored as a series of operating state points, i.e., the series of spectra ascending from low to high flux/lumens, and additional points interpolated between the states of the spectral series. The actual floating channel operating state will be somewhere in the series of low-to-high flux states of the color channel. i.e., greater than one point but less than the next point. So the true point is solved as a weighted average between the two points, and then the algorithm immediately iterates with the weighted average, given the X and Z terms of the weighted average nearest the actual flux may be slightly different than the initial mid-power XYZ color state used as the color basis for the first computation of the floating channel flux values. When solving the reduced channel system, it may be possible for there to be no solution. For example, if the defined gamut area does not include the color point of interest, the potential solution is determined to be a non-solution, and another color point is evaluated. In the calculations, there is no need to generate any CCT values or work with a combined spectrum, as with the empirical method. With the inverse solver algorithm, non-useful data points can be quickly discarded.

The first solution assumes the non-floating channels are all set to specific operating points (e.g., the solver engine 150 can sum their respective tristimulus values (e.g., XYZ) according to the source state record values together to yield a known aggregate lumens and a known color point. The remaining channels (e.g., 2 in the case of a 5 color channels lamp) can be designated as floating channels. That first solution depends on a color point "assumption" for each of the two floating channels from which the luminous level is solved. For example, the initial color point assumption of each floating channel may be the color point of the floating channel at 50% of its operating current range according to the precomputed table from the first part of the method 300. The floating channels have a known color point and a yet-to-determine luminosity prior to determining an inverse solution (e.g., a first solution). As the solver engine 150 solves for the first solution, the solver engine 150 can yield unique lumens values for each of the floating-channels (e.g., with floating color points) where the lumens values land on or substantially near the target color point based on the target parameter of the reference light source type. The assumed color point of the first solution (e.g., the lumens values solved by the solver engine 150) can be very close to the actual color point of the floating channels. For example, the actual color point may be slightly different because a difference in lumens values may result in a difference in junction temperature of LEDs of each color channel. Hence, the solver engine 150 can re-compute and refine the first solution iteratively. In several embodiments, within three iterative cycles, the refined solution can estimate the color tunable lamp's a color point within 1 part in 1000 or better of the actual state/color point of the color channel (e.g., an LED or an LED string).

When driving the color tunable lamp according to the lumens values of the first solution, the color tunable lamp can produce light fairly near the target color point. However, the actual color point of the floating channels is typically slightly different that the "average" color point assumption that the first solution was based on. Having an initial and close estimation of the operating states of all the color channels (e.g., including both luminous outputs, thermal power outputs, etc. of the color channels) enables a much closer estimation of the thermal state of the color tunable lamp. For example, the solver engine 150 can utilize an invariant thermal matrix estimator described later in this disclosure. The thermal matrix estimator can determine the contributing heat from neighbor LEDs to get a tight estimate of junction temperatures for each color channel and the flux state of each color channel. The accurate estimation of junction temperatures and the flux states yield a tighter estimation of the actual color point of each color channel from which to repeat the inverse solution for the lumens of each floating channel. Each repeated calculation can be considered a "refinement cycle."

After a first solution is obtained for the system at block 335, at block 340, the first solution is iteratively refined to determine the optimum weighting of the floating channels, the exact flux of the floating channels, and the true color point at the exact flux levels. The process at block 340 zeroes in on the precise operating point of the source channel. The flux is solved for by using the inverse method, but flux is sensitive to exact color point, and color point is sensitive to exact flux. Thus, the refining of the first solution can be achieved through iteration so that both criteria are met. Because the inverse solution can be pinned point quickly, and the color point look-up can be done quickly by referencing the source state record, the refinement of the solution of the floating channels can be quickly performed as well (e.g., prior to proceeding to full color metric analysis of such a solution). In some embodiments, any specified color metric or operating constraints (e.g., total power input constraint and operating temperature constraint) can be applied at this block to ensure that the identified solution meets the constraints.

Convergence on the refined solution occurs through repeating the steps of solving for lumens values of the floating channels by assuming color points of the floating channels, and using the lumens values to update the assumption of the color points. Repeated calculation would converge on an accurate solution. If this solved point meets basic color criteria and color/operating constraints (e.g., superior or minimum lumens, or lumen per watt, etc. . . . ), then the color computations can follow.

At block 345, the component tristimulus values that were pre-computed at block 325 are summed and weighted according to the refined solution determined at block 340, thus taking advantage of the associative properties of reflectivity and tristimulus values for the component color channels that contribute to a total spectrum produced by all the color channels. At block 345, the solver engine can compute an aggregate tristimulus value for each color card. The result is a tabulated aggregate eye response. With known temperature states and lumens values of each and every color channel, the associated pre-computation channel fractions can be pulled from pre-computation table (e.g., source state record) and summed quickly for each and every color card. This enables the solver engine 150 to quickly compare the color card points of the refined solution against the pre-computed reference lamp for all color metrics (e.g., CRI, R9, CQS, color errors, Qf, Qg, Qp, etc.)

The tabulated aggregate eye response can be used to optimize one or more color metric criteria and to check whether one or more color metric restraints are satisfied. For example, the color metric criteria and color metric restraints can involve power/output (e.g., based on power, lumens high/low, efficacy, or a combination thereof) and/or color quality. For example, the color quality can include XYZ fractions for each color card mapped to a standard color space, such as a fundamental eye response space), (U*,V*,W*) for CRI calculations, (L*, a*, b*) for CQS calculations, (L*, U*, V*), color quality metrics based on other color spaces (e.g., comparable 3-dimension spaces that a XYZ tristimulus value can map to), Different color spaces other than XYZ are designed to better normalize the "unit distance" for human detection of color difference between two points in a color space regardless of location in the color space. The operator of the solver engine 150 can specify color metric constraints, such as W* or L* response criteria (e.g., for enhanced spectra cases, such as red enhancement while maintaining "white" color source or green enhancement while maintaining "white" color source). The color metric constraint or criteria may also be Delta E, $R_i$'s, $CQS_i$, CQS, $Q_g$, $Q_f$, or $Q_p$ with respect to the reference spectrum. The operator of the solver engine 150 can also specify the color metric criteria or constraint based on a combination of the above color metrics, for example, as a geometric or weighted function.

Because the inverse solver algorithm solves for a specific CCT value, there is no color delta between the actual color point of the test spectrum and the reference spectrum. Thus, the calculations previously associated with the chromatic adaptation in the empirical method has been eliminated with the inverse solver algorithm. The von Kries adaptation is used for CRI, while a different adaptation is used for the metrics of CQS, nCRI, mCRI, where the effect of adaption approaches zero as the color difference between test and reference spectrum approaches zero, thus rendering adaptation irrelevant.

Then at block 350, the flux values of the floating channels can be read as the tabulated Y value of the aggregate tristimulus component values, thus yielding an aggregate color point for which the ΔE values relative to the one-time calculation of the reference spectrum performed at block 315 can be calculated along with the special CRI or R values, and the CRI value. At block 350, the solver engine 150 can calculate results of various other color metrics, such as R9, CRI, CQS, $Q_a$, $Q_g$, $Q_f$, or any combination thereof. At block 355, the solver engine 150 can select the refined solution to be included in the color model when one or more of the computed color metric satisfy their corresponding dynamic (e.g., optimal thus far) or a static requirements (maximum or minimum threshold).

FIG. 6A is a flow diagram illustrating a method 600 of building a pre-computation record for the inverse solver algorithm, in accordance with various embodiments. The method 600 can be similar to the first part of the method 300 described in FIG. 3A. At block 602, the model builder system 100 can select a reference light source type as a target for a color model to emulate at a target color characteristic. The target color characteristic can be defined by a target color parameter, such as CCT. The target color parameter quantifies the target color characteristic of the known reference light source type thus enabling the model builder system 100 to distinctively identify a target color point (e.g., represented by a tristimulus value). The color model can be used by a color tunable lamp (e.g., the N-channel lamp 110 of FIG. 1) to produce light that matches the target color parameter of the reference light source type. In some embodiments, the selection may be in response to receiving a user selection via a user interface of the model builder system 100.

In some embodiments, the reference light source type corresponds to a white light source, such as a black body lie spectrum or a "daylight" spectrum at a specified CCT. However as described above, the reference light source type can also take other predictable yet arbitrary form such that the model builder system 100 can construct a color model to match its output. For example, the reference light source type can be an enhanced white light that appears substantially "white" yet with one or more colors appear brighter than "normal" when illuminated by the enhanced white light. For another example, the enhanced white light may have certain parts of the spectrum absent. For another example, the reference light source type can be colored light, anywhere from white to a pure color tone, or a specified colored spectrum, such as classic stage lighting gel spectrum. The reference light source type can also be a "pre-filtered" spectrum—where a filter's transmission coefficient (or its inverse) is applied to a desired base reference spectrum—so that the pre-filtered spectrum may appear "strange" until an optical element (e.g., a filter or lens) is attached to the light source.

At block 604, the model builder system 100 can compute reference tristimulus values of the reference light source type for specific color cards. For example, the model builder system 100 can compute the reference tristimulus values by integrating, over the wavelength or frequency domain, product of a reference spectrum associated with the reference light source type multiplied by a reflectivity spectrum of the specific color cards. The reference spectrum can be a function of intensity with respect to wavelength or frequency. The reflectivity of the specific color cards can be a function of reflectivity with respect to wavelength or frequency. As a result of block 604, the model builder system 100 can build a precomputed table of reference tristimulus values corresponding to the target color point(s) and/or the target color point(s) reflected off of the specific color cards.

At block 606, the model builder system 100 can measure spectral power over sample steps in an operating range at the one or more temperature points of each color channel in the color tunable lamp. As a result of this step, the model builder system 100 can collect spectral power (e.g., a function of power intensity with respect to wavelength or frequency) with respect to various operating current values and various temperature points. The spectral power can be taken at a controlled temperature or at least a known temperature. For example, the temperature points can include a low, a medium, and a high setting, such as 20° C., 50° C., and 70° C. respectively. The model builder system 100 can also utilize a "thermal matrix" with the thermal capacitance to estimate (e.g., using a state estimator) an instantaneous temperature of each LED junction while rapidly scanning the spectral power. For example, the model builder system 100 can start at a stable state/temperature for a brief period, and then engage in a rapid series of differing spectra.

The sample steps can include additional samples near predicted inflection points in operating current. For example, a controller of the color tunable lamp may change from pulse width modulation to continuous current (e.g., at around 10% of maximum operating range to conserve power). These inflection points are known in advance when the color tunable lamp is designed, and hence there is not an "exploration" process of where they may be. The predicted inflection points can be features of the control hardware at specific regions of the control band of the color tunable lamp.

The model builder system 100 can fit the measured spectral power to a curve to get a continuous or semi-continuous spectral power curve to add additional steps to approximate the measured spectral power. The curve can be a spline (e.g., Catmull-Rom, cubic-B spline, Bezier, etc.) or a piece-wise linear or polynomial function. In several embodiments, the operating range is from minimum to maximum current. Over that operating range, output color typically changes slightly as the luminosity change. The color and luminosity for the same current can also change considerably with temperature. Hence, at block 606, the model builder system can create a "map" for each color channel, such as a surface approximated with sparse test spectra points across a range of current steps and temperature steps. The surface can be fitted to a surface function (e.g., spline surface) to those sample points in order to re-map to discrete table (e.g., ranging from low to high current). This re-mapping can be done to either linear stepping in luminosity (e.g. from 0, in steps of 0.001 of maximum lumens value to the max lumens value for each color channel), or geometric stepping in luminosity (e.g. from 0.001 of the maximum lumens value, to 0.001*1.01 of the maximum lumens value, to 0.001*1.01^2 of the maximum lumens value until 0.999 of the maximum lumens value).

At block 608, the model builder system 100 generates a source state record of component tristimulus values of the color channels of the color tunable lamp. The component tristimulus values of a color channel can include the component tristimulus value corresponding to the measured spectrum of the color channel and the component tristimulus values corresponding to the measured spectrum reflected off of the specific color cards. Because a method 650 (e.g., inner iterative solver calculations) performs its calculations in lumens/tristimulus space and then the color quality space (e.g. U*V*W*, or L*a*b*, etc.), block 608 generates the source state record to facilitate both the computations in the tristimulus space and the color quality space in the method 650. When the method 650 determines the lumens values and temperature as an "optimal" solution for a color channel, the actual operating control value (for each color channel) is determined using the map generated in block 606.

For example, the model builder system 100 can compute the component tristimulus values by integrating, over the wavelength domain, the product of multiplying the measured spectral power for each channel by reflectivity spectra associated with the specific color cards (e.g., the specification cards used in block 604). The model builder system 100 can construct the source state record as a floating-point vector for each color channel. The floating-point vector can include not only the component tristimulus values represented by scalar values (X,Y,Z) of each color channel, but also include operating current/drive signal, operating temperature, electrical wattage, radiometric emission wattage, etc. For example, an entry in the floating point vector can include parameters X, Y, Z representing color and lumens of an operating point, parameter W representing electrical watts, parameter R representing radiometric energy, parameter T representing temperature at a junction of light sources in the lamp, parameter P representing a control command value for the respective channel or an operating current of the channel.

For example, the source state record can include a 8-values-wide floating point vector. Other vector width can be used, such as a 16-values-wide vector. The same floating point vector can also be used to store parallel values for all the color states X1, X2, X3, X4, X5, etc., and Y1, Y2, Y3, etc., and Z1, Z2, Z3, etc. for each color card. Also $U_1$*, $U_2$*, . . . and $V_1$*, $V_2$*, and so on. In some embodiments, L*a*b* can be mapped out in parallel as well in the case of using CQS, $Q_a$, and/or $Q_v$ as a color metric.

In the method 600, blocks 602 and 604 can be executed independently of blocks 606 and 608. In some embodiments, the source state record can be combined in a file together with the reference tristimulus values. In various embodiments, the source state record and the reference tristimulus values are computed one time to support building of a color model in a method 650 described below.

FIG. 6B is a flow diagram illustrating a method 650 of solving for operating commands to a color tunable lamp such that the color tunable lamp produces light to match a target color point produced by a reference lamp type utilizing the pre-computation record of FIG. 6A, in accordance with various embodiments. The method 650 can be similar to the second part of the method 300 described in FIG. 3B.

At block 652, the model builder system 100 can divide color channels of the color tunable lamp into floating channels and non-floating channels. For example, the non-floating channels can be at least three channels and remaining color channels would be considered floating channels.

At block 664, the model builder system 100 traverses in steps through operating points of the non-floating color channels corresponding to the source state record to solve for flux values of the floating channels. Under the inverse solver algorithm, the model builder system 100 traverses through possible operating states of the non-floating channels while solving the floating channels via inverse computation. For example, for the non-floating channels, the traversing can go from a minimal output (e.g., no output when not driven by any current), to a maximum output (e.g., maximum brightness when driven by maximum current, such as represented by a digital value of "1024"). The spacing of the output (e.g., represented by the tristimulus value (X,Y,Z)) can be of linear, logarithmic, exponential, geometric, etc. For example, the traversing can step from (0,0,1) to (0,0,2) to (0,0,1024) to (0,1,1) to (0,1,2) and so on to (1024,1024,1024).

For example, the model builder system 100 can solve for the flux values of the floating channels by the following sub-steps. For example, at sub-block 656, the model builder system 100 inverse solves the flux values (e.g., as lumens values) of the floating channels as a first solution by assuming the non-floating channels are all set to operating points according to each step in the traversing.

The inverse solving at sub-block 656 can be done by calculating the lumens values of the floating channels while assuming the component tristimulus values of the non-floating channels yield a known aggregate lumens and a known color. Likewise, while inverse solving for the lumens values of the floating channels, the model builder system 100 can assume that the floating channels have known color points (e.g., according to the source state record) as well. For example, as a first solution, the model builder system 100 can assume that each floating channel has the color point corresponding to the floating channel operating at 50% of its operating current range. The inverse calculation is performed in the "lumens" space (instead of current or control command space). In some embodiments, the model builder system 100 utilizes a multivariate solver to solve/derive the lumens values that satisfies the assumed constraints (e.g., holding the lumens values of the non-floating channels constant, while finding the flux values of the floating channels that enables the color tunable lamp to match the reference color point of the reference light source type represented by the reference tristimulus values).

At sub-block 658, the model builder system 100 determines whether one or more target color points (e.g., represented by the reference tristimulus values calculated in block 604) falls within a gamut area defined by the floating channels at the calculated flux values (e.g., the inverse solving) and the non-floating channels at fixed operating points and thus fixed color point and aggregate brightness. At sub-block 660, the model builder system 100 traverses to a next step when the gamut area does not include the one or more target color points. That is, when the gamut area does not include the one or more target color points, the model builder system 100 treats the first solution as a non-solution.

At sub-block 660, when the gamut area does include the one or more target color points, the model builder system 100 iteratively refines the calculated lumens value and/or assumed color points for the floating channels. The model builder system 100 can check the refined solution after each refinement cycle to verify whether the refined solution produces a color point within the gamut area. A change in lumens of component color channels affects the color point of the color tunable lamp just as a change in the color point would require a change in lumens. What is unknown until an initial solution, is the exact temperature of each color channel. The channels are embodied in a grid or matrix, with each die temperature influenced by its neighbors' thermal output. With an initial solution in hand, using initial assumptions of temperature of each color channel, a much closer estimate of temperature (e.g., color point) is quickly solved, followed by a repeat of the first calculation. Exact junction temperature of each color channel and color state of each color channel can converge during the iterative calculation. With lumens and temperature of each color channel known, the model builder system can identify the operating commands, driving current, power, and thermal power from the source state record. Hence, the first solution derived at sub-block 656 can benefit from the fine-tuning of the calculated flux values.

The iterative process described in block 664 is an inverse computation that is designed to be compact and utilizes mathematic parallelism such that the inverse computation will yield a non-solution if the target color point (e.g., according to a reference tristimulus value) is outside of the gamut area defined by the operating parameters at each iterative step and the weights to the floating channels solved for in the same step. In several cases, it would take longer on average to see if the target color point is within the current gamut area polygon than to go directly to the inverse solution. Accordingly, in several situations, this iterative process is more computationally efficient than the alternatives.

As shown in sub-block 660, if the target color point does fall within the gamut area, the model builder system 100 can execute one or more refinement cycles. In the refinement cycles, instead of making an assumption of the color points of the floating channels, the model builder system 100 can look up the color points that correspond to the lumens values computed as part of the first solution in sub-block 656. In some embodiments, the model builder system 100 can look up the color points that also correspond to junction temperatures (e.g., as estimated by a thermal matrix) of the floating channels. The model builder system 100 can then use these color points to recalculate the lumens values. In some rare cases, the refinement cycle can end in a non-solution. Otherwise, during or after the refinement step, the model builder system 100 can filter the refined solution with a sequence of selection criteria (e.g., defined by color metric restraints). This can vary depending on what color metric that the color tunable lamp is being optimized for. For example, the model builder system 100 can optimize for total lumens or lumens per watt.

In some embodiments, as the model builder system 100 computes the refined solution and/or traverses through the steps, the model builder system 100 can maintain and keep track of a current best solution when evaluated against the color metric. If a new solution is better than the current best solution thus far in the selection criteria domain, the new solution is immediately checked to see if it satisfies other color quality requirements (e.g., other color metric). That is, if the new solution is better than or meets the selection criteria, then the color qualities are evaluated. If the new solution fails the checks against the other color quality requirements, then the model builder system 100 moves on to a next set of operating points. The model builder system 100 can compute one or more color qualities of the color tunable lamp when driven according to the new solution. The color quality computations can utilize the associative properties of component tristimulus values (e.g., assembling fractional X, Y, Z) to quickly produce full color points and evaluate for color quality measurements, such as CRI, $Q_a$ (CQS), or special $Q_i$, $Q_g$, $Q_f$, etc.

At sub-block 662, the model builder system 100 determines component tristimulus values corresponding to the refined solution calculated at sub-block 660. For example, the model builder system 100 can identify the component tristimulus values of the non-floating channels based on the step that yielded the first solution. The model builder system 100 can identify the component tristimulus values of the floating channels based on the calculated flux values in sub-block 660. Identifying the component tristimulus values can be a "table look-up" (e.g., of the source state record). In several embodiments, all determination of tristimulus values (e.g., raw or with respect to one or more color cards) in the method 650 can be by looking-up the pre-computed tristimulus values in the method 600. When a total/aggregate tristimulus value is to be determined, the model builder system 100 can perform a summation or weighting of tabular pre-computed tristimulus values. That is, in several embodiments, "determining tristimulus values" does not involve referring back to a measured or reference spectra and integrating.

At this step, the model builder system 100 can check against color or operating state constraints (e.g., maximum or minimum power usage or temperature). The color or operating state constraints can be specific to color channels. The color or operating state constraints can be specified via a user interface operated by the model builder system 100.

At sub-block 664, the model builder system sums the component tristimulus values of the non-floating channels and the floating channels to compute a total tristimulus value for the color tunable lamp at the operating states of the color channels corresponding to the refined solution. Delaying the summation step up till this point enables the inverse solver algorithm to push computing-resource-intensive integration task (e.g., at block 608) outside of the high-iteration portion (e.g., the method 650) of the inverse solver algorithm. For example, the X fragments associated with each color channel are pre-computed (e.g., by numerical integration) at block 608. Here, when the channel lumen fraction are known, the X fractions associated with each color card are summed up to get the same X that would result if the composite spectrum were integrated each and every cycle of the inner loop. This set up in the inverse solver algorithm effectively reduces thousands of multiply/add task cycles down to a few add tasks for the processing device 105.

At sub-block 666, the model builder system 100 can compute a color metric based on the total tristimulus value and the reference tristimulus values (e.g., calculated at block 604) to determine whether the refined solution satisfies a final solution requirement. This final solution requirement can be a dynamic requirement (e.g., a superior color quality or operating parameter, such as best color metric value thus far) or a static requirement (e.g., within a threshold color quality/other metric value). At block 668, if the refined solution satisfies the final solution requirement, the model builder system 100 includes the operating parameters, color metric values, component tristimulus values, total tristimulus value, or any combination thereof as part of the color model. Accordingly, the color model provides information for a controller of the color tunable lamp, during operation, to determine how to drive its color channels in order to match the target color point produced by the reference light source type defined at the color parameter specified.

While processes or blocks are presented in a given order in FIGS. 3A-3B and FIGS. 6A-6B, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. In addition, while processes or blocks are at times shown as being performed in series, these processes or blocks may instead be performed in parallel, or may be performed at different times. When a process or step is "based on" a value or a computation, the process or step should be interpreted as based at least on that value or that computation.

Figure 4:
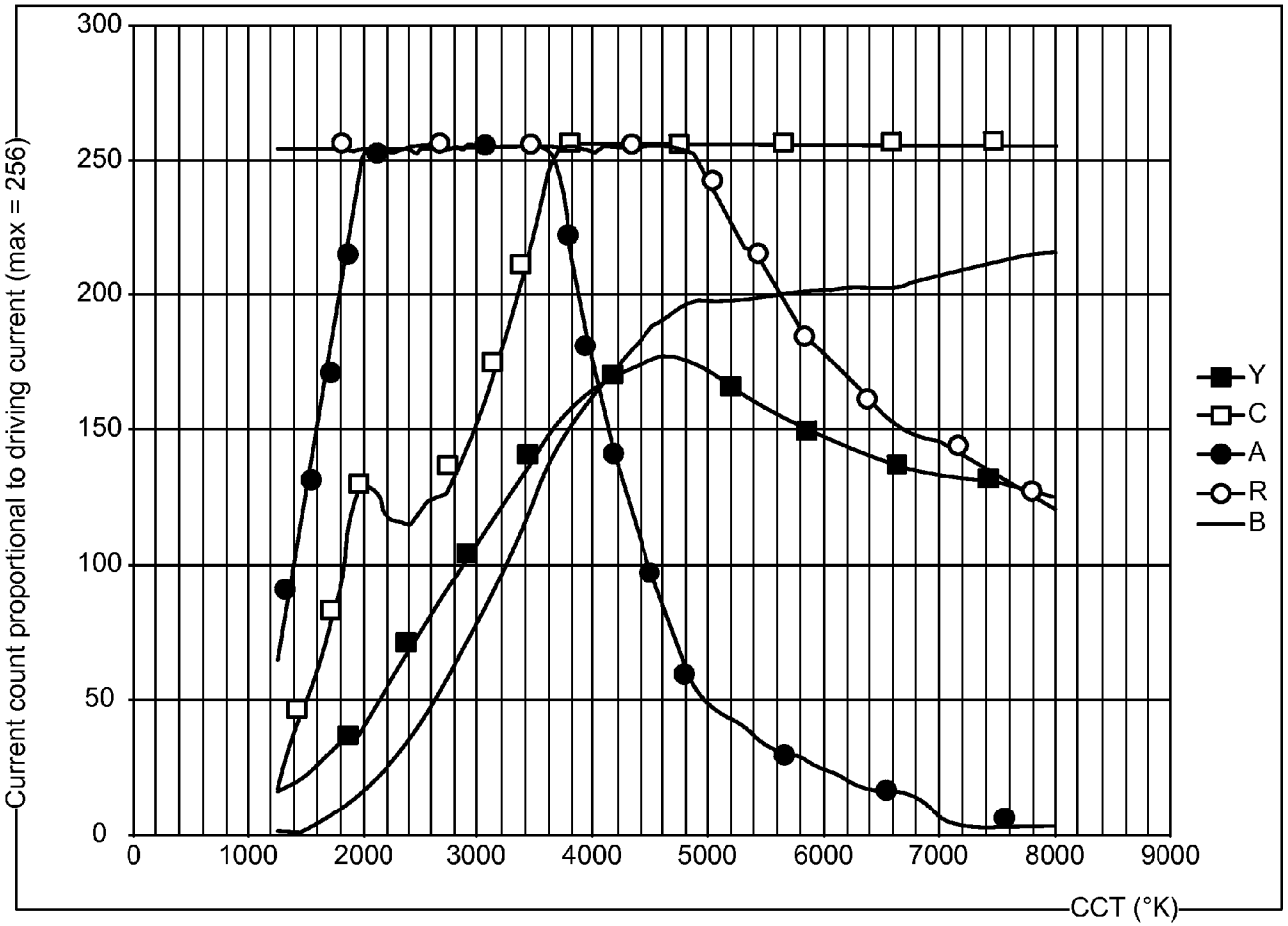
FIG. 4 shows a graph of a color model obtained for an example five channel LED-based lamp.

FIG. 4 shows a graph of a color model obtained for an example five channel LED-based lamp using the above-described inverse solver algorithm. The specified constraints for this color model are a minimum CRI of 90 and a minimum R9 value of 70. The x-axis shows the CCT value from approximately 1200K to 8000K, and the y-axis shows the relative amount of driving current used to drive each of the LED color channels. For the equipment used to drive the LEDs, the maximum driving current corresponds to a count of 256. Thus, the color model provides the optimum driving current for each of the LED color channels to obtain at least a CRI of at least 90 and at least an R9 value of 70.

Figure 5:
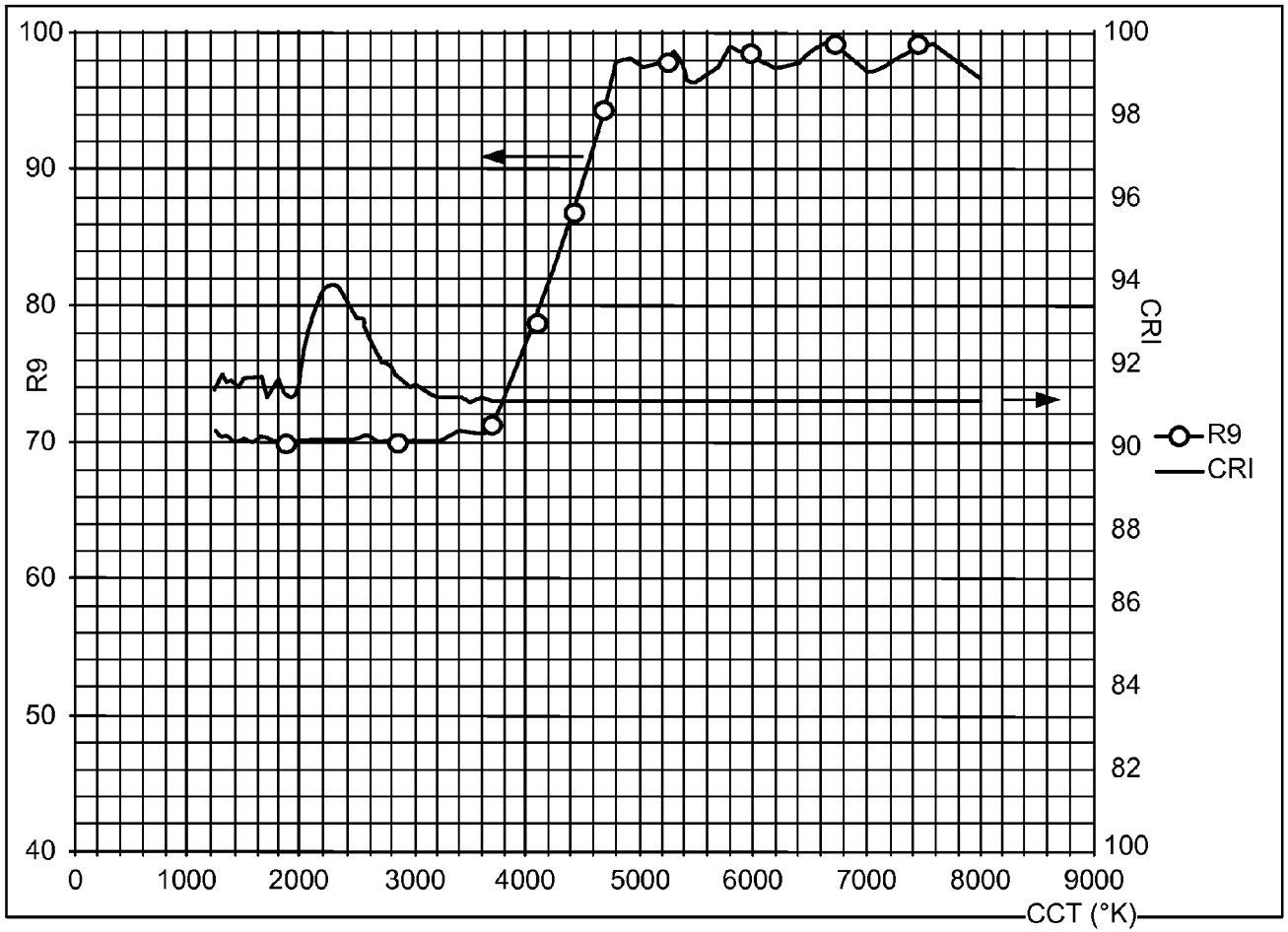
FIG. 5 shows a graph of the measured R9 and CRI values over a range of CCT values for the example LED-based lamp driven according to the color model shown in FIG. 4.

FIG. 5 shows a graph of the measured R9 and CRI values over a range of CCT values for the example LED-based lamp driven according to the color model shown in FIG. 4. The scale for the R9 values is shown on the left axis, and the scale for the CRI values is shown on the right axis. The driven values for the color channels thus yields the minimum CRI and R9 values that were specified as constraints. Advantages of the novel inverse calculation method The algorithm described above can be executed much more rapidly than the empirical calculations for many reasons. There is a large reduction in computational effort for each test point (e.g., the elimination of re-evaluating the reference spectrum for each test point), and the pre-computation and reduction of the spectral input data to tristimulus sub-components prior to iterating.

The algorithm uses an inverse calculation method that selectively maps all test points into a single color point, thus eliminating the need to accumulate large numbers (billions to trillions) of candidate solution points for subsequent comparison and data-messaging if the candidate solution points do not exactly coincide. New candidate points are immediately evaluated while still residing in the central processing unit (CPU) against the best known solutions, and are immediately adopted or discarded. By immediately evaluating candidate data points, many gigabytes of data no longer need be repeatedly moved in and out of the CPU/hard drive, as with the empirical method where the data is moved is all moved out, and then back in at least once.

The large speed improvement with the novel algorithm allows for the use of exhaustive brute force methods where the entire color combination space is finely divided and every point can be quickly tested.

The inverse calculation method also enables a family of multivariate optimization methods that otherwise would not be readily available to implement because the method requires every point in the color space that is evaluated to always map to a single color point.

With a "zoom" method, the color space is divided coarsely, typically into 64 steps, the best combination is found, and then a subset (typically 25% of the dimension of prior test space) of color space centered about the identified best point is re-evaluated at 64 steps (all-dimensions, within itself), and a new finer point is found and so on. With three iterations of the zoom method, full space at 64 steps, zoom to 25% of dimension about the best solution point, repeat the division of the zoomed space into 64 steps, zoom a second time to 25% of space; and iterate again with dividing the double-zoomed space into 64 steps and zooming to 25% of the space. The result of the zoom method repeated three times is a third and final subset space that is $1/16^{th}$ the dimension of the full space, iterated at a fineness of 64 steps, and this is the equivalent of a 1024-step (all dimensions) iteration of the original full space.

Other space-traversal trajectory methods may be employed, such as seeded max-slope trajectory type methods, but there are many variations. The common factor of the space-traversal trajectory methods is that all require that the selected color space test points map to a single color/CCT point for the precise derivatives associated with vectoring the space traversal to an optimum point to be meaningful. Because the inverse calculation method described above performs the required mapping, it is a suitable platform for implementing a wide variety of optimization methods.

Thermal Issues

It is also important to take into account the actual junction temperature of the LEDs in operation because the brightness and peak wavelength of LEDs shift with temperature changes. While a temperature sensor can be used near the LED array to obtain an approximate reference temperature, it is not sufficiently precise for the color model because in operation, the junction temperature drops off rapidly with distance from the junction. Additionally, the amount of local temperature drop-off is a function of the operating state, driving current and efficiency of the LED. Also, the temperature of an LED can be effected by the heat generated by neighboring LEDs.

A thermal matrix (e.g., a digital model of the thermal property of the light sources, such as LEDs) can be generated that takes into account how much neighboring operating light sources influence each other, so that the closer a light source (e.g., LED) is to its neighbor, the more influence it will have. The thermal matrix can be geometry-specific. That is, the thermal matrix can be the same for lamps within the same product line. The thermal matrix can be a thermal resistance matrix defining the "influence" of near neighbors power levels on the "local" temperature of a LED.

For another example, the thermal matrix can include a thermal capacitance matrix. That is, the thermal matrix can include the thermal resistance matrix, the thermal capacitance matrix, or a combination thereof. The thermal capacitance matrix enables the inverse solver algorithm to provide operational state tables that can be used for a state estimator/observer (e.g., the model builder system 100 of FIG. 1) that is predicting the local LED temperatures during rapid thermal transients—characteristic of what routinely happens in stage/entertainment lighting or during the moment of "dimming" of a white LED source that undergoes "warm dimming," which simulates an incandescent light source where the color temperature drops as the lamp dims down. In some embodiments, the thermal matrix includes both the thermal resistance network of pathways between adjacent LED in an array and the local heat capacity of the local base that the LEDs attach to and its influence on the state of the LEDs during rapid transitions (e.g., in color or output or both).

The thermal matrix can be a fixed linear matrix of thermal coefficients that describe the thermal interactions between the LEDs in the array, and the thermal matrix can be used with the inverse solver algorithm described above to more accurately adjust for the driving current for each color channel to obtain a desired output intensity at a given CCT value. Each array has a characteristic invariant matrix describing the thermal state of each LED junction relative to the temperature sensor and the operating state of all the other LEDs in the array. The array does not vary significantly for a given physical lamp or LED layout. Concurrently, with the solution of the color point, the thermal operating point (temperature and heat production) can be solved integral to the color metrics. The array may be used in the lamp internal model for solution of operating state for arbitrary temperature and dimming value.

The spectral data captured for the thermal computations can include spectra at a low, medium, and high operating temperature and multiple points from the low to high current for each channel, typically a minimum of five current levels. For example, for a 5-channel system, the number of spectra to be taken is given by: $5\times(5\times3)$ or 45 spectra. In a production system, the spectral data can be captured in less than ten seconds using an active Peltier heater/cooler to drive the LED array to different temperature points.

Applications

The above described techniques can be used in a variety of applications. For example, color models can be generated in a manufacturing environment that makes LED-based lamps. Advantages to using the inverse solver algorithm over the empirical method for generating color models include having a high throughput, being able to use pre-binned LEDs with varying tolerances in a lamp while still being able to control the LEDs of the lamp to generate specific color points having specific color quality constraints, and identifying optimal color point solutions to use for specific manufactured lamps.

In some embodiments, the color models can be stored in a memory at a controller for controlling the color and/or intensity of the lamps, or at the lamps themselves to allow a user of the lamp to control the lamp to a desired color output. In some embodiments, the color models can be stored on a chip positioned near the LED array, and in conjunction with the chip, a universal LED driver can be used to drive the LEDs to obtain the output spectral data used for generating the color models. As a result, the chip can be coupled to any LED-based lamp to turn the lamp into a tunable color lamp. The LED driver can be a "digital radiometric" type driver, which is a driver that produces highly repeatable current levels to all the LED channels (insensitive to the limits of various analog components), and thereby enabling the separation of the driver from the inverse solver algorithm's task. For several types of built-in drivers, the inverse solver algorithm is configured to "solve out" the variations in the driver. For the case of the digital radiometric type drivers, ratios of ultimate current delivered to each color channel is based on high-resolution digital timing ratios and exhibits high repeatability.

In yet another example application, color models can be generated for use in a research and development environment, such as for investigating properties and functionality for different LED phosphors, different color systems, color sensitivities, and for identifying different bins for categorizing LEDs in manufacturing environment for LED-based lamps. A person of skill in the art will understand that the techniques described herein can also be used in a variety of other applications.

FIG. 7 is a block diagram of an example of a computing device 700, which may represent one or more computing device or server described herein, in accordance with various embodiments. The computing device 700 can be one or more computing devices that implement the model builder system 100. The computing device 700 includes one or more processors 710 and memory 720 coupled to an interconnect 730.

The processors 710 can represent different processor cores of a CPU. In some embodiments, the solver engine 150 can examine a target color point (e.g., a color point of a reference lamp type for the color tunable lamp to match) at a time. However, with multiple cores, each core can simultaneously examine a different target color point. The processors 710 can include a processor cache 715. The processor cache 715 and the processor 710 together enables the solver engine 150 to operate even faster. That is, the pre-compute tables produced from the method 600 are designed to fit in standard processor caches. Unlike conventional programs that cannot help but to dip in/out of memory or drive units, slowing execution manyfold, the solver engine 150 can light up the processors 710 and all the data necessary fit compactly within the processor cache 715 alone. When dealing with very "large" problem sets like this, it is unique to be able to do so (e.g., with little/no interaction with ram/network/drive).

The interconnect 730 shown in FIG. 7 is an abstraction that represents any one or more separate physical buses, point-to-point connections, or both connected by appropriate bridges, adapters, or controllers. The interconnect 730, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire".

The processor(s) 710 is/are the central processing unit (CPU) of the computing device 700 and thus controls the overall operation of the computing device 700. In certain embodiments, the processor(s) 710 accomplishes this by executing software or firmware stored in memory 720. The processor(s) 710 may be, or may include, one or more programmable general-purpose or special-purpose microprocessors, digital signal processors (DSPs), programmable controllers, application specific integrated circuits (ASICs), programmable logic devices (PLDs), trusted platform modules (TPMs), or the like, or a combination of such devices.

The memory 720 is or includes the main memory of the computing device 700. The memory 720 represents any form of random access memory (RAM), read-only memory (ROM), flash memory, or the like, or a combination of such devices. In use, the memory 720 may contain a code 770 containing instructions according to the mesh connection system disclosed herein.

Also connected to the processor(s) 710 through the interconnect 730 are a network adapter 740 and a storage adapter 750. The network adapter 740 provides the computing device 700 with the ability to communicate with remote devices, over a network and may be, for example, an Ethernet adapter or Fibre Channel adapter. The network adapter 740 may also provide the computing device 700 with the ability to communicate with other computers. The storage adapter 750 enables the computing device 700 to access a persistent storage, and may be, for example, a Fibre Channel adapter or SCSI adapter.

The code 770 stored in memory 720 may be implemented as software and/or firmware to program the processor(s) 710 to carry out actions described above. In certain embodiments, such software or firmware may be initially provided to the computing device 700 by downloading it from a remote system through the computing device 700 (e.g., via network adapter 740).

The techniques introduced herein can be implemented by, for example, programmable circuitry (e.g., one or more microprocessors) programmed with software and/or firmware, or entirely in special-purpose hardwired circuitry, or in a combination of such forms. Special-purpose hardwired circuitry may be in the form of, for example, one or more application-specific integrated circuits (ASICs), programmable logic devices (PLDs), field-programmable gate arrays (FPGAs), etc.

Software or firmware for use in implementing the techniques introduced here may be stored on a machine-readable storage medium and may be executed by one or more general-purpose or special-purpose programmable microprocessors. A "machine-readable storage medium," as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible storage medium includes recordable/non-recordable media (e.g., read-only memory (ROM); random access memory (RAM); magnetic disk storage media; optical storage media; flash memory devices; etc.), etc.

The term "logic," as used herein, can include, for example, programmable circuitry programmed with specific software and/or firmware, special-purpose hardwired circuitry, or a combination thereof.

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the embodiments is not intended to be exhaustive or to limit the embodiments to the precise form disclosed above. While specific examples for the embodiments are described above for illustrative purposes, various equivalent modifications are possible within the scope of the embodiments, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or subcombinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the embodiments.

Any patents and applications and other references noted above, including any that may be listed in accompanying filing papers, are incorporated herein by reference. Aspects of the embodiments can be modified, if necessary, to employ the systems, functions, and concepts included in such references to provide further implementations of the embodiments.

These and other changes can be made to the embodiments in light of the above Detailed Description. While the above description describes certain examples of the embodiments, and describes the best mode contemplated, no matter how detailed the above appears in text, the embodiments can be practiced in many ways. Details of the system may vary considerably in its specific implementation, while still being encompassed by the embodiments disclosed herein. As noted above, particular terminology used when describing certain features or aspects of the embodiments should not be taken to imply that the terminology is being redefined herein to be restricted to any specific characteristics, features, or aspects of the embodiments with which that terminology is associated. In general, the terms used in the following claims should not be construed to limit the embodiments to the specific examples disclosed in the specification, unless the above Detailed Description section explicitly defines such terms. Accordingly, the actual scope of the embodiments encompasses not only the disclosed examples, but also all equivalent ways of practicing or implementing the embodiments under the claims.

While certain aspects of the embodiments are presented below in certain claim forms, the applicant contemplates the various aspects of the embodiments in any number of claim forms. For example, while only one aspect of the embodiments is recited as a means-plus-function claim under 35 U.S.C. §112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for.") Accordingly, the applicant reserves the right to add additional claims after filing the application to pursue such additional claim forms for other aspects of the embodiments.

Some embodiments of the disclosure have other aspects, elements, features, and steps in addition to or in place of what is described above. These potential additions and replacements are described throughout the rest of the specification.

What is claimed is:

1. A computer-implemented method of generating a color model to drive a color tunable lamp having multiple color channels, the method comprising:

selecting a reference light source type for the color model to emulate at a target color point produced by the reference light source types defined by a color parameter;

computing reference tristimulus values of the reference light source including tristimulus values corresponding to specific color cards;

measuring spectral power over sample steps in an operating range at one or more temperature points of each color channel in the color tunable lamp;

generating a source state record of the each color channel including component tristimulus values of the each color channel;

dividing the multiple color channels into one or more non-floating channels and one or more floating channels;

traversing in steps through operating points of the non-floating channels corresponding to the source state record to inversely solve for lumens values of the floating channels by assuming the non-floating channels are set to specific operating points according to each step in the traversing;

and defining the color model based on the inversely solved lumens values when a gamut area, defined by the floating channels at the inversely solved lumens values;

wherein the non-floating channels at the specific operating points according to the each step includes the target color point.

2. The computer-implemented method of claim 1, wherein generating the source state record includes:

computing the component tristimulus values by integrating product of the measured spectral power for the each color channel multiplied by reflectivity spectra of the specific color cards; and constructing the source state record of the color channels as a floating point vector, the source state record includes the tristimulus values associated with each operating point of the each color channel.

3. The computer-implemented method of claim 1, wherein at least three of the multiple color channels are designated as the non-floating channels and remaining color channels are designated the floating channels.

4. The computer-implemented method of claim 1, wherein the traversing in the steps includes defining the gamut area based on a known color point and a known aggregate lumen of the non-floating channels.

5. The computer-implemented method of claim 1, wherein the traversing in the steps includes defining the gamut area by holding the floating channels at a known color point with variable lumens values.

6. The computer-implemented method of claim 1, wherein the traversing in the steps includes:

determining whether the target color point falls within the gamut area; and traversing to a next step when the target color point falls outside of the gamut area.

7. The computer-implemented method of claim 1, wherein the traversing in the steps includes:

determining whether the target color point falls within the gamut area; and refining the lumens values when the target color points falls inside of the gamut area.

8. The computer-implemented method of claim 7, wherein the refining the lumens values includes:

determining an updated color point and an updated junction temperature of the color tunable lamp utilizing the lumens values of a previously refinement cycle for the floating channels and the specific operating points of the non-floating channels; and calculating a refined lumens values of the floating channels as a next solution according to the updated color point and the updated junction temperature.

9. The computer-implemented method of claim 8, further comprising:

determining whether the next solution satisfies a color metric requirement; and wherein defining the color model includes adding the next solution associated with the target color point to the color model when the next solution satisfies the color metric requirement.

10. The computer-implemented method of claim 9, wherein determining whether the next solution satisfies the color metric requirement includes:

computing total tristimulus values, respective to the specific color cards, of a combined spectrum of both the non-floating channels and the floating channels according to the next solution by referencing the source state record; and computing a color metric by comparing the total tristimulus values against the reference tristimulus values of the reference light source type at the target color point.

11. The computer-implemented method of claim 9, wherein the color metric requirement is a dynamic requirement for optimizing for a highest value of a color metric when traversing the steps.

12. The computer-implemented method of claim 9, wherein the color metric requirement is a static requirement with a color metric maximum or minimum threshold.

13. The computer-implemented method of claim 9, wherein the color metric requirement is a static requirement with a color metric maximum or minimum threshold.

14. The computer-implemented method of claim 8, wherein the refining the lumens values includes optimizing for an operating parameter of the next solution by selecting the next solution based on electrical wattage, radiometric emission wattage, temperature, control command value, lumens per watt, thermal heat generated, or any combination thereof.

15. A model builder system for generating a pre-computation record for a color tunable lamp and a target reference lamp to facilitate building of a color model for the color tunable lamp, the model builder system comprising:

an optical system having a spectral analyzer and an optical sensor for measuring spectral power;

a memory having executable instructions;

a processor, configured by the executable instructions to perform a method comprising:

selecting a reference light source type for the color model to emulate at a target color point produced by the reference light source types defined by a color parameter;

computing reference tristimulus values of the reference light source including tristimulus values corresponding to specific color cards;

measuring spectral power over sample steps in an operating range at one or more temperature points of each color channel in the color tunable lamp using the optical system; and generating a source state record of the each color channel including component tristimulus values of the each color channel.

16. The model builder system of claim 15, wherein the processor is further configured to generate the source state record by computing the component tristimulus values based on integrating, over wavelength domain, product of the measured spectral power for each color channel multiplied by reflectivity spectrum of the specific color cards.

17. The model builder system of claim 15, wherein the processor is further configured to generate the source state record as a floating point vector; and wherein the source state record includes the component tristimulus values associated with each operating point of each color channel.

18. The model builder system of claim 15, wherein the processor is further configured to map the measured spectral power to a surface function to approximate a continuous or semi-continuous surface of spectral intensity in dimensions of temperature and operating current.

19. The model builder system of claim 18, wherein the surface function is a spline surface.

20. The model builder system of claim 15, wherein the sample steps includes additional samples near predicted inflection points in operating current.

21. The model builder system of claim 15, wherein the specific color cards are defined by one or more color quality standards and are represented by reflectivity spectra.

22. A computer-implemented method of generating a color model to drive a color tunable lamp having multiple color channels, the method comprising:

dividing the multiple color channels into one or more non-floating channels and one or more floating channels;

traversing in steps through operating points of the non-floating channels corresponding to a source state record of measured spectral characteristics to inversely solve for lumens values of the floating channels by assuming the non-floating channels are set to specific operating points according to each step in the traversing; and defining the color model based on the inversely solved lumens values when a gamut area, defined by the floating channels at the inversely solved lumens values and the non-floating channels at the specific operating points according to the each step, includes a target color point of a reference lamp; and wherein the color model indicates a set of operating parameters to drive the multiple color channels to produce the target color point.

23. The computer-implemented method of claim 22, wherein the traversing in the steps includes:

determining whether the target color point falls within the gamut area; and traversing to a next step when the target color point falls outside of the gamut area.

24. The computer-implemented method of claim 22, wherein the traversing in the steps includes:

determining whether the target color point falls within the gamut area; and refining the lumens values when the target color points falls inside of the gamut area.

* * * * *